United States Patent [19]

Matlock et al.

[11] 4,277,318

[45] Jul. 7, 1981

[54] ELECTROCHEMICAL BENZYLIC OXIDATIONS

[75] Inventors: Paul L. Matlock, White Plains; Michael R. Sandner, Chappaqua, both of N.Y.

[73] Assignee: Union Carbide Corporation, New York, N.Y.

[21] Appl. No.: 140,610

[22] Filed: Apr. 15, 1980

[51] Int. Cl.[3] ..... C25B 3/02

[52] U.S. Cl. ..... 204/78

[58] Field of Search ..... 204/78

[56] References Cited

U.S. PATENT DOCUMENTS

| | | | |
|---|---|---|---|
| 808,095 | 12/1905 | Lang | 204/78 |
| 2,110,273 | 3/1938 | McKee et al. | 204/9 |
| 3,616,323 | 10/1971 | Covitz | 204/78 |
| 3,714,003 | 1/1973 | Engelbrecht et al. | 204/78 |
| 3,745,180 | 7/1973 | Rennie | 204/78 |
| 3,758,391 | 9/1973 | Anderson et al. | 204/78 |
| 3,897,319 | 7/1975 | Anderson et al. | 204/78 |
| 4,089,757 | 5/1978 | Halter | 204/78 |
| 4,148,696 | 4/1979 | Halter | 204/79 |
| 4,212,710 | 7/1980 | Halter et al. | 204/78 |
| 4,212,711 | 7/1980 | Halter et al. | 204/78 |

*Primary Examiner*—R. L. Andrews

*Attorney, Agent, or Firm*—Bernard Francis Crowe

[57] ABSTRACT

Benzylic methylene groups are oxidized electrolytically to ketones using a combination of a biphasic aqueous-organic solvent system, a phase transfer catalyst, and a manganese compound in a divided cell.

12 Claims, No Drawings

ELECTROCHEMICAL BENZYLIC OXIDATIONS

BACKGROUND OF THE INVENTION

This invention pertains to electrochemical benzylic oxidations and more particularly to the formation of aromatic ketones thereby.

Several electrochemical benzylic oxidations to form aromatic ketones are known. The crudest are performed as a slurry of substrate in acidic or basic electrolyte. These are characterized by a multitude of products, including ring hydroxylation products and further oxidation to quinone, in addition to benzylic oxidation. Direct oxidation has been investigated in homogeneous solvent, using t-butanol as a cosolvent. Tetralin, oxidized under these conditions affords a mixture of α-tetralone, α-tetralol, and the α-(t-butyoxy)ether. The most favorable current efficiency obtained under these conditions was about 11% with α-tetralone as the product. The addition of inorganic salts to slurries of substrate and electrolyte has been investigated also. Manganous sulfate was the additive used. Russian workers reported that the yield of acetophenone from ethylbenzene rose from 42–45 to about 50–51% upon the addition of manganous sulfate to a slurry of ethylbenzene with either sulfuric acid or sodium hydroxide electrolyte. It is not clear from the context of this work if the researchers refer to electrical efficiencies as yield, although yield generally refers to the percentage of consumed substrate transformed into product, not the percentage of current that was used to oxidize product. Swiss researchers have reported permanganate ion can be regenerated electrochemically to oxidize o-toluene-sulfamide to benzoic acid sulfimide. In the oxidation of 2,4-dinitrotoluene to 2,4-dinitrobenzoic acid, chromium trioxide has proven to be the preferred additive.

There appears to be only one reference in the technical literature of the use of phase transfer catalysis in electrochemistry. L. Eberson et al., *Acta. Chem. Scand. B*, 29, (1975) 451–6, and *Chem. Scr.* 5, (1974), 47–48 reported a high yield aromatic cyanation when a biphasic aqueous-organic solvent system was used in the presence of a phase transfer catalyst (tetrabutylammonium sulfate). The phase transfer catalyst was used to ensure a high nucleophile concentration in the organic phase.

SUMMARY OF THE INVENTION

A method of oxidizing benzylic methylene groups to ketones has been developed which comprises utilizing a membrane divided electrolytic cell having an anolyte compartment and a catholyte compartment, each fitted with an anode and cathode, respectively, in a closed circuit connected to a d.c. power source, by:

(a) charging said anolyte compartment with a mixture of a hydrocarbon having about 7 to about 30 carbon atoms and at least 1 benzylic methylene group; about 0.01 to about 10,000 moles of 0.001 to 30 N aqueous mineral acid per mole of hydrocarbon, about $1\times10^{-6}$ to about 100 moles of a manganese compound per mole of hydrocarbon and a catalytic amount of a phase transfer catalyst in one phase, together with about 0.1 to about 10,000 moles of an alkylene halide having 2 to about 6 carbon atoms per mole of hydrocarbon in a second phase;

(b) charging about 0.01 to about 10,000 moles of 0.01 to 30 N aqueous mineral acid per mole of hydrocarbon to the catholyte compartment; and (c) passing sufficient direct current through said electrolytic cell to convert the hydrocarbon benzylic methylene groups to ketone groups.

Representative examples of useful hydrocarbon substrates containing benzylic methylene groups include:

ethyl benzene
tetralin
p-methoxyethyl benzene
propyl benzene
diphenyl methane
1,2-diphenylethane
indan
p-chloroethyl benzene Illustrative mineral acids used in this invention include sulfuric acid, hydrochloric acid, phosphoric acid, perchloric acid, nitric acid, and the like.

The choice of manganese compounds is not narrowly critical and includes compounds where manganese is in the I, II, III, IV, V, VI, VII, −III, −II, −I, and oxidation state O. The preferred compounds are those in which manganese is present in the oxidation states of II, IV, or VII. Representative examples of manganese in the II oxidation state include manganous sulfate, manganous perchlorate, manganous nitrate, and the like. Representative manganese compounds wherein manganese is in the IV oxidation state include manganese dioxide, $MnF_4$, $Mn(SO_4)_2$, and the like. Representative compounds containing manganese in the VII oxidation state include potassium permanganate, $MxO_3F$, and the like.

The phase transfer catalyst used in this invention can be any large inert cationic species in the form of an ammonium salt, a phosphonium salt, and the like known in the art. A preferred phase transfer catalyst is sold under the trademark Aliquot 336 (a tricaprylmethylammonium cation with either chloride or bisulfate as the counter ion sold by General Mills Company). Other examples of phase transfer catalysts which can be used include tetrabutylammonium chloride, dodecyltriethylammonium bromide, hexadecyltributylphosphonium bromide, and the like.

Although other organic solvents other than alkylene halides can be used the preferred organic solvent used to make the biphasic solvent system with water and mineral acid is methylene chloride. Other solvents which can be used include chloroform, 1,2-dichloroethane, ethyl acetate, and the like.

The nature of the electrodes used in either the anolyte or catholyte compartments is not critical. Exemplary electrodes which can be used in either compartment include platinum, palladium either in wire, sheet, gauze or other form, carbon, lead, nickel, and the like. It is preferred to use platinum as the anode and carbon as the cathode, however. It was unexpectedly found that, using a platinum anode and a small amount of potassium permanganate as the manganese compound in the anolyte compartment to start oxidation, solid manganese dioxide formed from spent permanganate which could be regenerated electrochemically to permanganate. It was further startling to find more α-tetralone in a tetralin oxidation with this system than could be accounted for by the potassium permanganate initally added. Calculated electrical efficiencies ranged from about 10 to about 58%. In order to show that high conversion could be achieved with this approach tetralin was oxidized to a 32% conversion. In this case the electrical efficiency was 28% and the chemical efficiency was 86%. α-Tetralone was the only product derived from tetralin in this experiment. The observed selectivity thus was 100%.

The invention is further described in the examples which follow. All parts and percentages are by weight unless otherwise specified.

EXAMPLE 1

Electrochemical Oxidation of Tetralin

An electrochemical H cell was constructed from two 4-inch pieces of 1¾ inch glass pipe, sealed and squared off at the bottom. A 42 mm OD, 23 mm ID ring seal ball joint was connected with a standard tapered joint just above the bottom of the resulting cylinder. The faces of the ball joints were ground to form a recess ring in which washers fashioned from Buna N rubber were mounted. These washers were used to hold a cationic exchange membrane purchased from Ionics Incorporated under the stock No. 61AZL183. The resulting assembly was held together with a clamp. Teflon caps were placed over the top of each side of the H cell, with electrodes positioned through holes in the cap. A carbon rod cathode was used. The anode consisted of a platinum gauze cylinder 3.5 cm in diameter and 2 cm high.

The electrolyte was prepared from 135 ml of water and 15.31 g of sulfuric acid. 70 ml of the electrolyte was placed in the cathode side of the assembled electrochemical cell and 40 ml in the anode side. To the anode side of the cell were added 0.3159 g potassium permanganate (1.99 millimoles), 3.74 g of tetralin (28.3 millimoles), 0.48 g of Aliquot 336 (tricaprylmethylammonium chloride)(1.1 millimoles), 0.314 g of tridecane, and 30 ml of methylene chloride. Both chambers were stirred and a 5.00 volt d.c. potential was impressed across the cell for 24 hours during which time 812.9 coulombs of electricity (8.42 milliequivalents) were passed. The product was extracted from the anolyte compartment with methylene chloride. The methylene chloride was washed with water, followed by saturated aqueous sodium carbonate, then saturated aqueous sodium chloride and finally dried over magnesium sulfate, filtered and concentrated on a spinning evaporater. Analysis was performed by glc (gas liquid chromatography Varian 2700 gas chromatograph) (⅛ inch×8 inch 15% S.E. 30 column, temperature programmed from 90°–120° C. at 4°/min, 15 minutes at 120° C.); indicated the presence of 0.280 grams of α-tetralone (1.91 millimoles) which after subtracting the amount formed from the potassium permanganate added (0.69 millimoles) indicates an electrical efficiency of 58%. 3.38 Grams of tetralin (25.2 millimoles) were recovered thus indicating a mass balance of 96%.

EXAMPLE 2

Electrochemical Oxidation of Ethylbenzene

An electrochemical oxidation of 3.00 g of ethylbenzene (28.3 millimoles) was performed using the method described in Example 1 with the exception that 0.1744 g of dodecane were used as an internal standard, 0.31 grams of Aliquot 336 (0.7 millimoles) were added, and 0.3100 g of potassium permanganate (1.96 millimoles) were added to the anolyte. 1,749 Coulombs (18.12 milliequivalents) were passed through the cell at +5.00 volts d.c. over a period of 6 hours and 55 minutes. After recovery of the oxidized product as described in Example 1, gas liquid chromatography analysis indicated the presence of 84.9 milligrams of acetophenone (0.708 millimoles), which corresponds to a 1% electrical efficiency after correcting for the 0.658 millimoles of acetone formed as a result of the potassium permanganate originally added. 2.97 Grams of ethylbenzene (28.0 millimoles) were recovered for a material balance of 102%.

EXAMPLE 3

Electrochemical Oxidation of Tetralin with the Oxidation Carried to High Conversion The oxidation of tetralin was performed as described in Example 1 except that 0.2855 grams of potassium permanganate (1.81 millimoles) was used to initiate the oxidation. 7,960 Coulombs (82.5 milliequivalents) were passed through the cell over a period of 89 hours and one minute. Analysis showed the presence of 0.944 grams of α-tetralone (6.46 millimoles). After correcting for the 0.630 millimoles formed from the potassium permanganate initially added, this corresponds to an electrical efficiency of 28%. 2.088 grams of Tetralin (15.8 millimoles) were recovered for a material balance of 96%. The conversion of tetralin was 32% and the chemical efficiency was 86%. Selectivity was 100% to α-tetralone.

EXAMPLE 4

Oxidation of Tetralin with Manganese Dioxide Coated Electrode

The coating of manganese dioxide was applied to the anode by electrolyzing the platinum electrode at a voltage of +2.50 d.c. in a 0.50 molar solution of manganous sulfate in 1.4 molar aqueous sulfuric acid solution until 173.9 coulombs had passed through the cell. Based on several experiments, this procedure results in 21–23 mg (0.24–0.27 millimoles) of manganese dioxide being deposited on the platinum electrode surface. The procedure used in Example 1 with the coated platinum electrode was then followed. This cell was then used to oxidize 3.15 grams of tetralin (23.86 millimoles). This example differed from Example 1 in that no potassium permanganate was added. 0.428 Grams of Aliquot 336 (0.83 millimoles) was used as the bisulfate salt instead of the chloride salt. 450.7 Coulombs (4.67 milliequivalents) was passed through the cell over a period of 39 hours and 43 minutes. Gas liquid chromatography analysis showed a product of 0.172 grams of α-tetralone (1.22 millimoles) for an electrical efficiency of 105% and 2.93 grams tetralin (22.17 millimoles) for a material balance of 98%.

EXAMPLE 5

The Oxidation of Ethylbenzene using Manganese Dioxide Coated Electrode

This example utilized the platinum electrode coated with manganese dioxide prepared as described in Example 4. This platinum electrode was used to oxidize 3.29 grams of ethylbenzene (31.0 millimoles) as described in the previous example, except that no additional manganese was added and 0.30 grams of Aliqout 336 (0.68 millimoles) was used in the form of the chloride salt. 383.7 Coulombs (3.98 milliequivalents) were passed through the electrolytic cell over 23 hours and 52 minutes. Analysis showed the presence of 37.6 milligrams of acetophenone (0.313 millimoles) for an electrical efficiency of 32% and 3.24 grams of ethylbenzene (30.6 millimoles) for a material balance of 100%.

EXAMPLE 6

Electrochemical Oxidation of Tetralin to Form a $MnO_2$ Coated Electrode

A coating $MnO_2$ was applied to the platinum electrode by conducting an oxidation of 3.26 grams of tetralin (25.5 millimoles) as described in Example 1 initiated by 0.2639 grams of potassium permanganate (25.5 millimoles). A total of 1,415 coulombs (14.66 milliequivalents) were passed through the electrolytic cell over a period of 1 hour and 41 minutes. Gas liquid chromatography analysis showed 0.225 grams of α-tetralone was formed. An electrical efficiency of 26% was calculated. 3.28 Grams of tetralin (24.8 millimoles) was recovered for a material balance of 103%. The electrode from this oxidation, visibly coated with manganese dioxide was used in Example 7 following after washing with water and methylene chloride.

EXAMPLE 7

Electrochemical Oxidation of Ethylbenzene with a Manganese Dioxide Coated Electrode The platinum electrode coated in the previous Example No. 6 during the course of the tetralin oxidation was used for the oxidation of 2.84 grams of ethylbenzene (26.8 millimoles). The electrode was used as in Example 2 with the exception that no manganese salts were added. To the electrolytic cell was added 0.28 grams of Aliquot 336 (0.63 millimoles). 224 Coulombs (2.32 milliequivalents) were passed through the cell over a period of 23 hours and 48 minutes. Gas liquid chromatography analysis indicated a yield of 39.6 milligrams of acetophenone (0.33 millimoles) for an electrical efficiency of 57% and 2.56 grams of ethylbenzene for a material balance of 92%. The electrode from this experiment was washed with water and methylene chloride and used in Example 8 following.

EXAMPLE 8

Electrochemical Oxidation of Tetralin with a Manganese Dioxide Coated Electrode This example demonstrates the further use of the manganese dioxide coated electrode prepared in Example 6 and used to oxidize ethylbenzene in Example 7. In this example, this coated electrode was used to oxidize 3.48 grams of tetralin (26.4 millimoles) as described in Example 1 except that no added manganese salts were used. 214.7 Coulombs (2.22 milliequivalents) were passed through the electrolytic cell over a period of 28 hours. Standard work up showed 38.9 milligrams α-tetralone (0.266 millimoles) for an electrical efficiency of 48% and 3.63 grams of tetralin (27.5 millimoles) for a material balance of 105%.

EXAMPLE 9

Electrochemical Oxidation of Tetralin using Manganous Sulfate as the Manganese Source An oxidation of 3.02 grams of tetralin (22.9 millimoles) was performed as described in Example 1 with the following exceptions: 0.714 grams of $MnSO_4 \cdot H_2O$ (4.23 millimoles) were substituted for the $KMnO_4$ and 0.34 grams of Aliquot 336 (0.77 millimoles) were used. 371.5 Coulombs (3.85 milliequivalents) were passed through the cell over a period of 40 hours and 56 minutes. Standard work up showed 0.148 grams α-tetralone (1.01 millimoles) for an electrical efficiency of 105% and 3.02 grams of tetralin (22.9 millimoles) for a material balance of 105%.

EXAMPLE 10

Electrochemical Oxidation of Ethylbenzene using Manganous Sulfate as the Manganese Source An ethylbenzene oxidation was performed as described in Example 2, except that 0.6617 grams of manganous sulfate (3.92 millimoles) were substituted for potassium permanganate and 3.38 grams of Aliquot 336 (0.86 millimoles) were used for the oxidation of 2.80 grams of ethylbenzene (26.4 millimoles). 284.2 Coulombs (2.95 milliequivalents) were passed through the electrolytic cell over a period of 40 hours and 47 minutes. Gas liquid chromatography analysis showed the product contained 44.5 milligrams of acetophenone (0.371 millimoles) for an electrical efficiency of 50% and 2.74 grams of ethylbenzene (25.8 millimoles) for a material balance of 99%.

CONTROL A

Electrochemical Oxidation of Tetralin in the Absence of Manganese

This run was performed to show the importance of manganese in the electrochemical oxidations of this invention. An attempt to oxidize 3.55 grams of tetralin (26.9 millimoles) was carried out as described in Example 1, except that no manganese in any form was added to the electrochemical cell and 0.35 grams of Aliquot 336 (0.79 millimoles) were added. 92.0 Coulombs (0.95 milliequivalents) were passed through the cell over a period of 22 hours and 47 minutes. Standard work up showed 3.69 grams of tetralin (28.0 millimoles) but no α-tetralone for a material balance of 104%.

CONTROL B

Attempted Electrochemical Oxidation of Tetralin in the Absence of Phase Transfer Catalyst This run demonstrates the importance of phase transfer catalyst in the electrochemical oxidations in the presence of 0.23 grams of potassium permanganate (1.47 millimoles). The electrochemical oxidation of 3.19 grams of tetralin (24.2 millimoles) was attempted using the procedure described in Example 1, except that no phase transfer catalyst was added. 1,824 Coulombs (18.9 milliequivalents) were passed through the electrolytic cell over a period of 4 hours. After standard work up, gas liquid chromatography analysis showed the presence of 63 milligrams of α-tetralone (0.432 millimoles) which was calculated to be due entirely to the oxidation by the 1.47 millimoles of potassium permanganate initially added. 3.20 Grams of tetralin (24.2 millimoles) were recovered for a material balance of 102%.

CONTROL C

Attempted Oxidation with a Manganese Dioxide Coated Electrode in the Absence of Phase Transfer Catalyst This run was carried out to demonstrate the importance of phase transfer catalysts in electrochemical oxidations using a manganese dioxide coated electrode. The attempted electrochemical oxidation of 3.26 grams of tetralin (24.7 millimoles) was performed in an identical manner with Example 2 except that no phase transfer catalyst was added. 1200 Coulombs (12.4 milliequivalents) were passed through the electrolytic cell over a period of 3 hours and 30 minutes. Gas liquid chromatography analysis showed no α-tetralone and 3.49 grams of tetralin (26.4 millimoles) for a material balance of 107%.

CONTROL D

Attempted Electrochemical Oxidation of Tetralin with Manganese Sulfate but Without Phase Transfer Catalyst This run demonstrates an electrochemical oxidation of 3.02 grams of tetralin (22.9 millimoles) with 0.746 grams of manganese sulfate (4.41 millimoles) as the manganese source but without any phase transfer catalyst present. The oxidation was performed as described in Example 3 but without any phase transfer catalyst being present. 398.9 Coulombs (4.13 milliequivalents) were passed through the electrolytic cell over a period of 51 hours and 34 minutes. Gas liquid chromatography analysis show the presence of a 0.152 grams of α-tetralone (1.04 millimoles) for an electrical efficiency of 101% and 2.94 grams of tetralin (22.3 millimoles) for a material balance of 102%.

CONTROL E

Attempted Electrochemical Oxidation of Ethylbenzene in the Absence of Phase Transfer Catalyst This run demonstrates the importance of phase transfer catalyst in ethylbenzene oxidations using 0.694 grams of manganous sulfate (4.11 millimoles) as the manganese source. A 2.76 gram sample of ethylbenzene (26.0 millimoles) was oxidized in a manner identical to Example 5 except that no phase transfer catalyst was added. 1,132 Coulombs (11.73 milliequivalents) were passed through the electrolytic cell over a period of 5 hours and 14 minutes. Gas liquid chromatography analysis show the absence of any acetophenone and 270 grams of ethylbenzene (25.5 millimoles) for a mass balance of 98%.

EXAMPLES 11–18

Benzylic Oxidations Using Electrochemically Regenerated Permanganate

Eight examples were run using an anolyte solvent consisting of 1:1 of 1 molar sulfuric acid and methylene chloride, Aliquot 336 phase transfer catalyst, a voltage of +5 d.c., the divided cell described in Example 1 together with platinum anode and ambient temperatures. Several hydrocarbon substrates were used including ethylbenzene, p-methoxy ethylbenzene, tetralin, 1,2-diphenylethane, fluorene, toluene, and p-xylene. The reaction conditions, yields and other pertinent data are presented in Table I.

Although the invention has been described in its preferred forms with a certain degree of particularity, it is understood that the present disclosure of the preferred forms has been made only by way of example and that numerous changes may be made without departing from the spirit of the scope of the invention.

TABLE X

BENZYLIC OXIDATIONS USING ELECTROCHEMICALLY REGENERATED PERMANGANATE

Solvent = 1:1 $1MH_2SO_4:CH_2Cl_2$
Phase Transfer Catalyst = Aliquot 336[R]
V = +5.00
divided cell (Ionics Inc. 61AZL 183 cationic exchange membrane
Platinum working electrode
T = ambient

| Run No. | Substrate (mmol) | mmol $KMnO_4$ | Coulombs | Average Current (mamp) | Product (%ee)[a] | Mass Balance |
|---|---|---|---|---|---|---|
| 1 | 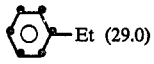 Et (29.0) | 1.61 | 1.974 | 244 | 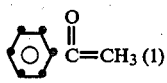 C=CH3 (1) | 98 |
| 2 | 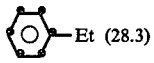 Et (28.3) | 1.96 | 1,749 | 70 | 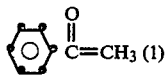 C=CH3 (1) | 102 |
| 3 | MeO 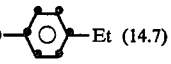 Et (14.7) | 1.57 | 1,783 | 21 | MeO 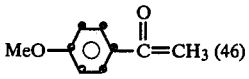 C=CH3 (46) | 82 |
| 4 | 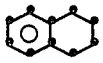 (29.6) | 1.76 | 1,635 | 19 | 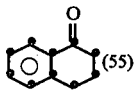 (55) | 96 |
| 5 | 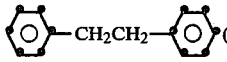 CH2CH2 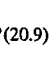 (20.9) | 1.90 | 3,568 | 212 | 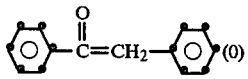 C=CH2  (0)<br> 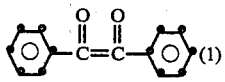 C=C  (1) | 87 |
| 6 | 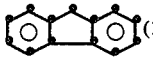 (15.1) | 1.74 | 3,319 | 213 | 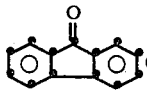 (5.6) | 87 |
| 7 | 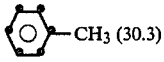 CH3 (30.3) | 1.90 | 3,464 | 251 | 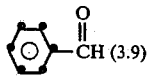 CH (3.9) | 106 |

TABLE X-continued

BENZYLIC OXIDATIONS USING ELECTROCHEMICALLY REGENERATED PERMANGANATE

Solvent = 1:1 $1MH_2SO_4:CH_2Cl_2$
Phase Transfer Catalyst = Aliquot 336[R]
V = +5.00
divided cell (Ionics Inc. 61AZL 183 cationic exchange membrane
Platinum working electrode
T = ambient

| Run No. | Substrate (mmol) | mmol $KMnO_4$ | Coulombs | Average Current (mamp) | Product (%ee)[a] | Mass Balance |
|---|---|---|---|---|---|---|
| 8 | 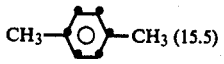 (15.5) | 1.76 | 3,441 | 155 | 2 minor products | 92 |

[a]In calculating electrical efficiencies, the amount of product formed electrochemically was determined by substracting the calculated amount of product formed from the permanganate added initially from the gross amount of product.

What is claimed is:

1. Method of oxidizing benzylic methylene groups to ketones which comprises in a membrane divided electrolytic cell having an anolyte compartment and a catholyte compartment each fitted with an anode and cathode respectively in a closed circuit connected to a d.c. power source, (a) charging said anolyte compartment with a biphasic aqueous-organic solvent system comprising a hydrocarbon having about 7 to about 30 carbon atoms and at least one benzylic methylene group, about 0.01 to about 10,000 moles of 0.001 to 30 N aqueous mineral acid per mole of hydrocarbon, about $1\times10^{-6}$ to about 100 moles of a manganese compound per mole of hydrocarbon, and a catalytic amount of a phase transfer catalyst in one phase, together with about 0.1 to about 10,000 moles of an alkylene halide having 2 to about 6 carbon atoms per mole of hydrocarbon in a second phase;

(b) charging 0.01 to about 10,000 moles of 0.01 to 30 N aqueous mineral acid per mole of hydrocarbon to the catholyte compartment; and (c) passing sufficient direct current through said electrolytic cell to convert the hydrocarbon benzylic methylene groups to ketone groups.

2. Method claimed in claim 1 wherein the substrate it tetralin.

3. Method claimed in claim 1 wherein the substrate is ethylbenzene.

4. Method claimed in claim 1 wherein the manganese compound contained manganese in the II oxidation state.

5. Method claimed in claim 1 wherein the manganese compound contained manganese in the IV oxidation state.

6. Method claimed in claim 1 wherein the manganese compound contained manganese in the VII oxidation state.

7. Method claimed in claim 1 wherein the phase transfer catalyst was tricaprylmethylammonium chloride or bisulfate.

8. Method claimed in claim 1 wherein the voltage across the electrolytic cell was about 0.5 to about 100 volts d.c.

9. Method claimed in claim 6 wherein the manganese compound was potassium permanganate.

10. Method claimed in claim 1 wherein the anode was platinum and the cathode was carbon.

11. Method claimed in claim 1 wherein the alkylene halide is methylene chloride.

12. Method claimed in claim 1 wherein the oxidation product was isolated by extracting the anolyte with an alkylene halide having 2 to about 6 carbon atoms.

* * * * *

UNITED STATES PATENT AND TRADEMARK OFFICE

CERTIFICATE OF CORRECTION

PATENT NO. : 4,277,318

DATED : July 7, 1981

INVENTOR(S) : Paul L. Matlock et al.

It is certified that error appears in the above—identified patent and that said Letters Patent is hereby corrected as shown below:

At Column 2, line 32, "$MxO_3F$," should read -- $MnO_3F$, --.

Claim 2, Column 10, line 17, "it" should read -- is --.

Signed and Sealed this

*Sixth* Day of *October 1981*

[SEAL]

*Attest:*

GERALD J. MOSSINGHOFF

*Attesting Officer*

*Commissioner of Patents and Trademarks*